United States Patent [19]

Suginaka

[11] Patent Number: 5,063,692

[45] Date of Patent: Nov. 12, 1991

[54] FOOTWEAR AND INSOLE PAD THEREOF

[76] Inventor: Junko Suginaka, Sunhaimu shinsaibashi 607, 10-12, nishishinsaibashi 1-chome, Chuo-ku, Osaka-shi, Japan

[21] Appl. No.: 528,193

[22] Filed: May 24, 1990

[51] Int. Cl.[5] ..... A43B 13/38; A61F 5/00

[52] U.S. Cl. ..... 36/43; 36/94; 128/81 R; 128/581

[58] Field of Search ..... 36/43, 44, 94, 11.5; 128/81 R, 581

[56] References Cited

U.S. PATENT DOCUMENTS

| | | | |
|---|---|---|---|
| 3,468,040 | 9/1969 | Fukuoka | 36/11.5 |
| 3,825,017 | 7/1974 | Scrima | 36/44 X |
| 4,020,570 | 5/1977 | Shames | 36/44 |
| 4,124,946 | 11/1978 | Tomlin | 36/11.5 X |
| 4,446,633 | 5/1984 | Scheinhaus et al. | 36/11.5 |
| 4,669,142 | 6/1987 | Meyer | 36/44 X |
| 4,694,831 | 9/1987 | Seltzer | 36/11.5 X |

FOREIGN PATENT DOCUMENTS

| | | | |
|---|---|---|---|
| 8901745 | 3/1989 | PCT Int'l Appl. | 36/11.5 |

*Primary Examiner*—Paul T. Sewell
*Assistant Examiner*—Beth Anne C. Cicconi
*Attorney, Agent, or Firm*—Wenderoth, Lind & Ponack

[57] ABSTRACT

Footwear and an insole pad employed inside thereof, in which an arch extrusion being raised toward the outside thereof is provided at an outer periphery corresponding to an outside arch on the upper surface of an insole of the footwear or on the upper surface of the insole pad, so that the shift of weight rested on a foot upon walking toward the outside upon walking is supported by the arch extrusion and the weight rested on the foot is gathered to the center of a body, which improves a walking posture, reduces the fatigue of the foot and prevents the occurrence of bowlegs.

4 Claims, 4 Drawing Sheets

FOOTWEAR AND INSOLE PAD THEREOF

BACKGROUND OF THE INVENTION

1. Field of the Invention

The present invention relates to footwear and an insole pad to be laid inside of the footwear, and more particularly, to a structure of the footwear and the insole pad thereof which prevents deformation of a foot by supporting the outward shift of the weight rested on the foot so that a walking posture is well maintained and the shape of the footwear is retained.

2. Description of the Related Art

Three arches on the sole of the foot, known as the three loading arches, function as springs, which makes it possible to move in every direction. The three arches include a plantar arch, an outside arch and a crossing arch at the front of the foot.

The arches discussed above are constituted by twenty-six bones reinforced by muscles and ligaments; however, since these are not firm, the muscles and the ligaments become fatigued and the arches start falling after standing for a long time.

In conjunction with the falling of the arches, the spring efficiency deteriorates, which results in a deterioration in the functions of the foot.

The human foot, sometimes called "the second heart", is composed of a five-layered musculative and blood vessels flow in the midst of the muscles. The blood therefore is pumped up by the contractile muscle movement upon walking and is returned to the heart.

Thus it is desirable to prevent fallen arches caused by resting one's weight on one's foot for a long time and to provide a means for assisting the natural blood circulation system.

FIG. 10 shows a structure of an insole for a conventional shoe 1 and FIG. 11 shows a structure of an insole pad 3 lying on the insole 2 in the shoe 1, in which the entire surface of the insole 2 or the insole pad 3 is flat, or an extrusion 4 is provided at the plantar arch alone to thicken the insole 2 or the insole pad 3.

As shown in FIG. 12, when walking, the weight rested on the foot tends to shift from an outside part (a) to an outside front part in the direction shown by an arrow (b).

The insole 2 employed in the conventional shoe 1 or the insole pad 3 laid on the insole 2 has no ability to support the shift in weight described above. As a result, as shown in FIGs. 10 and 11, the weight shift is supported by an instep strap 5 positioned at the outside of the shoe 1, which leads to a disadvantage of deformation of the shoe caused by the expansion of the instep strap 5 while wearing the shoe.

Further, a force directed to the outside is directed through the entire foot, and can cause bowleggedness.

Bowleggedness can occur particularly significantly among children whose skeletal structures of feet have not yet been completed, not to mention adults whose skeletal structures have been completed.

SUMMARY OF THE INVENTION

The object of the present invention is to provide footwear and an insole pad thereof by which a walking posture is by transferring the weight rested on the foot during walking to the inside of one's body so as to reduce the fatigue of the feet and to prevent the occurrence of bowleggedness.

In order to overcome the problems and the disadvantages as described above, according to the present invention, there is provided footwear in which an arch extrusion rising toward the outside thereof is provided at an outer periphery corresponding to an outside arch of a foot on the upper surface of an insole of the footwear; and an insole pad in which an arch extrusion raised toward the outside thereof is provided at the outer periphery corresponding to the outside arch of the foot on the upper surface of the body of the insole pad.

By wearing the footwear or insole pad, the outside arch of the foot is fitted to the arch extrusion provided on the upper surface of the insole or on the upper surface of the insole pad laid on the insole, so that the outward shift of the weight rested on the foot during walking is supported by the arch extrusion and is shifted to the center of ones body, whereby walking posture is improved so as to reduce fatigue and so as to prevent bowleggedness.

BRIEF DESCRIPTION OF THE DRAWINGS

For a more complete understanding of the present invention, reference may be made to the following description of an exemplary embodiment taken in conjunction with the accompanying drawings in which.

DETAILED DESCRIPTION OF THE PREFERRED EMBODIMENTS

Figure 1:
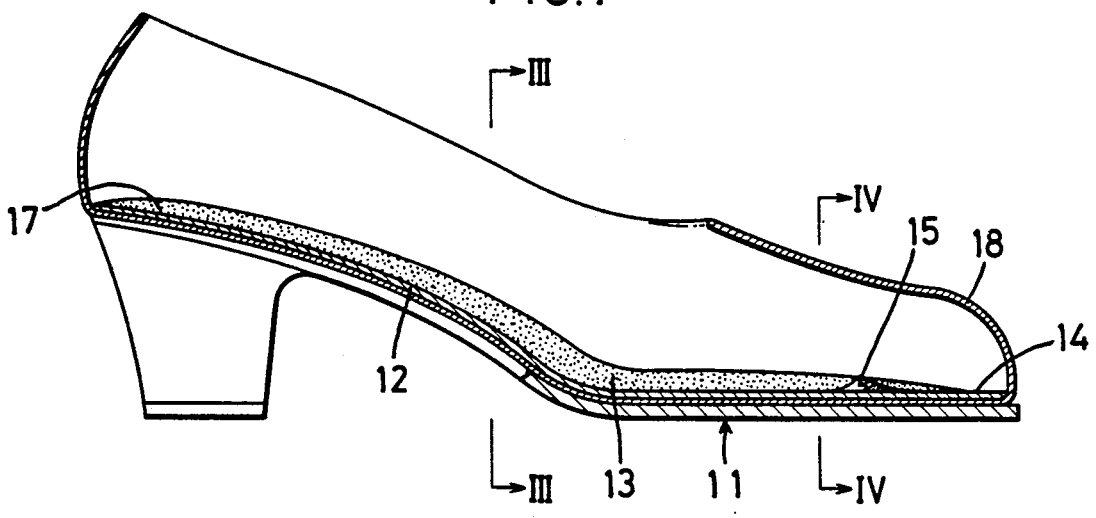
FIG. 1 is a longitudinal sectional view of footwear according to the present invention.

Preferred embodiments of the present invention will be explained with reference to the appended drawings.

FIGs. 1 to 4 show a shoe as an exemplification of footwear.

The shoe 11 includes, on the upper surface of an insole 12, disposed within upper 18, a curving arch extrusion 13 rising toward the outside thereof at an outer periphery corresponding to an outside arch of a foot A; an extrusion 15 for preventing a slippage provided at a location corresponding to a concavity between the first and the second toes of the foot A on a front stepped-on portion 14; and a curving arch extrusion 16 being being raised toward the outside thereof along a periphery of a plantar arch.

Materials to produce the insole 12, the arch extrusions 13 and 16 and the extrusion 15 are not particularly limited. With the use of silicon, for example, pleasant senses of wearing and walking can be obtained due to its good air-permeability and elasticity.

The insole 12, the arch extrusions 13 and 16 and the extrusion 15 may be formed as a body of the same material; or they may be formed separately using the same material or different materials followed by fixation by means of adhesion, deposition and the like.

Figure 2:
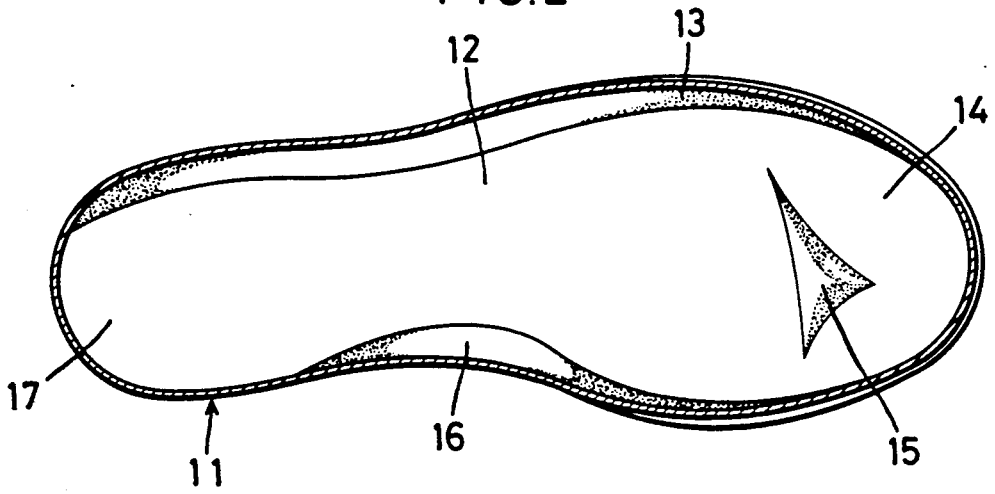
FIG. 2 is a cross-sectional plan view of the footwear shown in FIG. 1.
Figure 3:
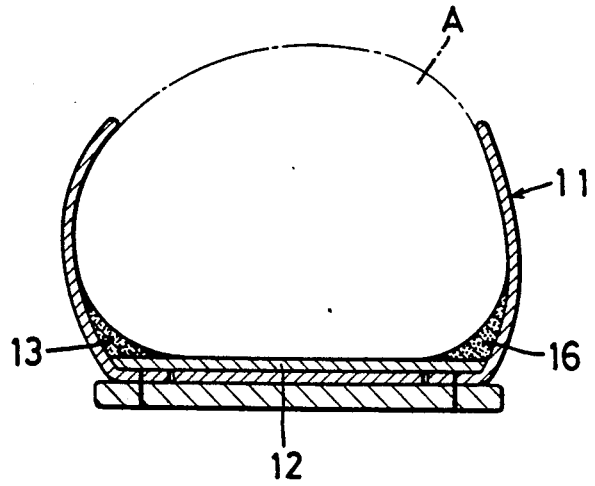
FIG. 3 is a longitudinal sectional view taken along arrows III—III in FIG. 1.

As shown in FIGs. 1 and 2, the outside arch extrusion 13 is provided along the outer periphery of the insole 12, extending from the tip of the front stepped-on portion 14 through a back stepped-on portion 17. The arch extrusion 13 may also be provided around the whole periphery of the insole 12 so that the arch extrusions 13 and 16 are formed continuously.

Further, the arch extrusion 13 may be provided partially at an outside of the front stepped-on portion 14 where the rested weight particularly tends to shift toward the outside of the foot.

Both arch extrutions 13 and 16 are formed in a manner in which the cross-sectional shapes thereof and thicknesses thererof are fit to the outside arch of the foot and the plantar arch, respectively. The extrusion 15 for preventing slippage is formed to have a low generally triangular pyramidal shape so that it is fit to the concavity between the first and the second toes of the foot.

The structure and the shape of the shoe 11 are not confined to those shown in the drawings; the shoe may be produced for men, women, adults or children. Further any designs and varieties such as a leather shoe, a sports shoe, a high heel, a slipper, a sandal, a golf shoe and so on may employ the structure and the shape of the insole pad according to the present invention.

An insole pad of footwear as shown in FIGs. 5 to 9 will be now explained.

In the description of the insole pad, the identical numerals are used to designate portions having the same structure as those in the aforementioned insole 12 of the shoe 11.

The insole pad 21 laid on the insole 12 of the shoe 11 includes, on the upper surface of an insole pad body 22 having a shape fitted to the plain-shaped insole 12, the arch extrusion 13 provided at the outer periphery corresponding to the outside arch of the foot A; the extrusion 15 for preventing slippage provided at a location corresponding to a concavity between the first and second toes of the foot A on a front stepped-on portion 14; and the curving arch extrusion 16 raised toward the outside thereof along a periphery of a plantar arch.

The above-discussed arch extrutions 13 and 16 and extrusion 15 for preventing a slippage are formed in the same manner as those provided with the aforementioned insole of the shoe.

Figure 4:
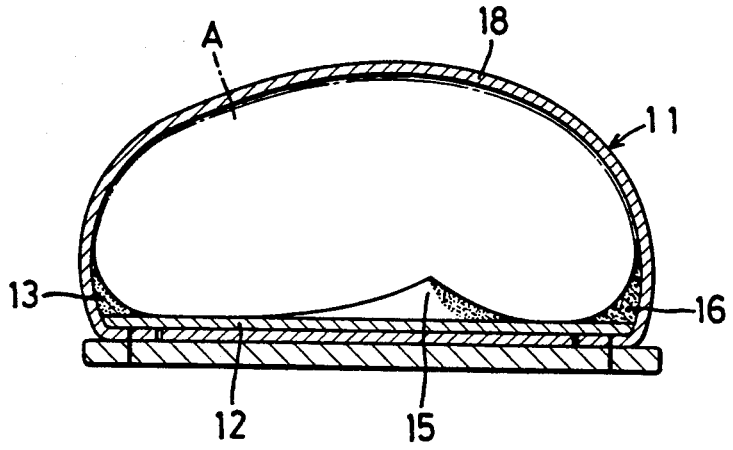
FIG. 4 is a longitudinal sectional view taken along arrows IV—IV in FIG. 1.
Figure 5:
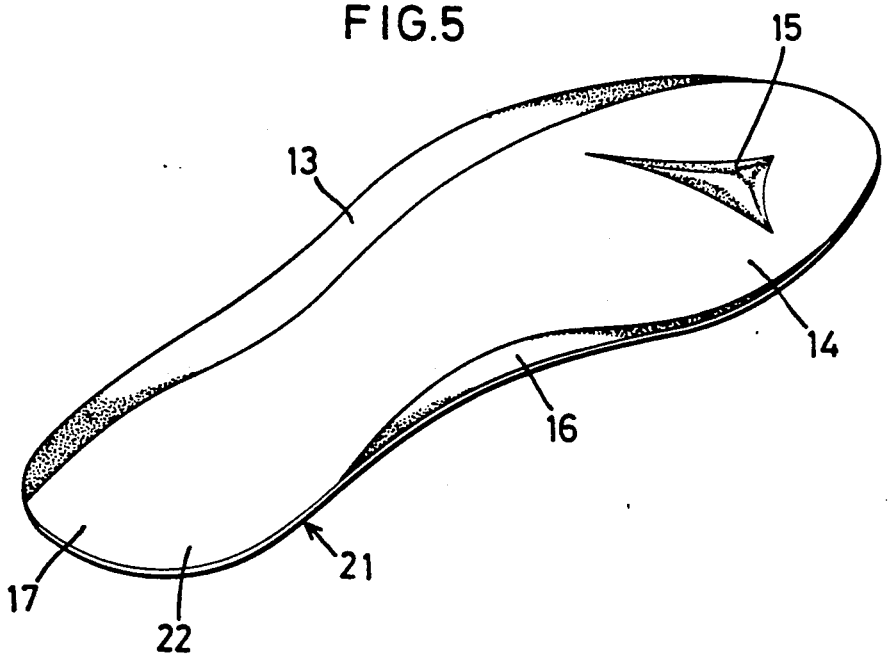
FIG. 5 is an obligue view of an insole pad according to the present invention.
Figure 6:
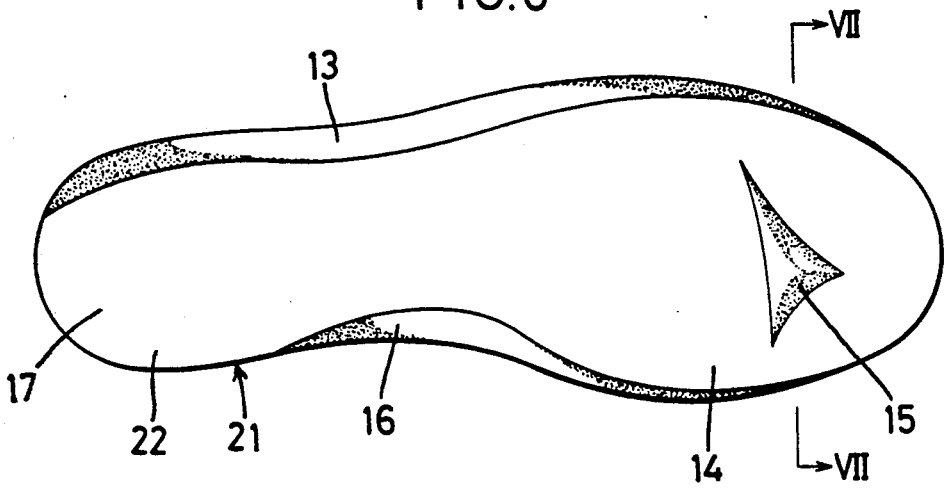
FIG. 6 is a plan view of the insole pad as shown in FIG. 5.
Figure 7:
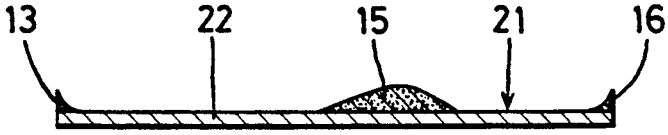
FIG. 7 is a sectional view taken along arrows VII—VII in FIG. 6.
Figure 8:
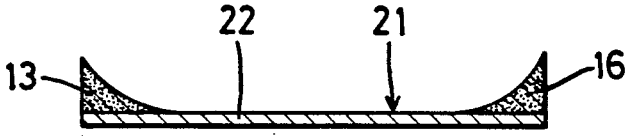
FIG. 8 is a sectional taken along arrows VIII—VIII in FIG. 6.
Figure 9:
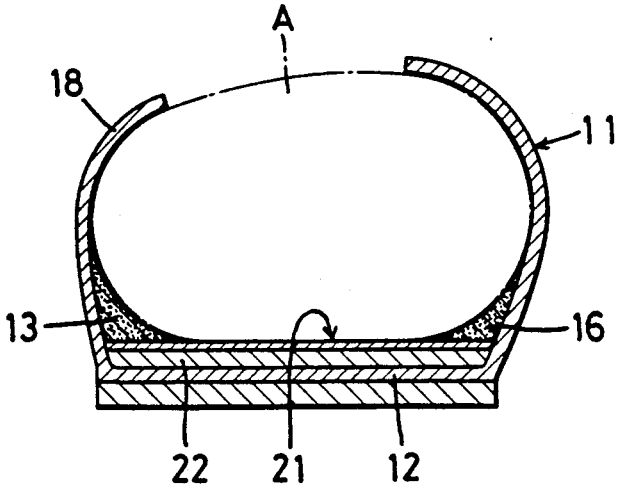
FIG. 9 is a longitudinal sectional view of an application of the insole pad according to the present invention.
Figure 10:
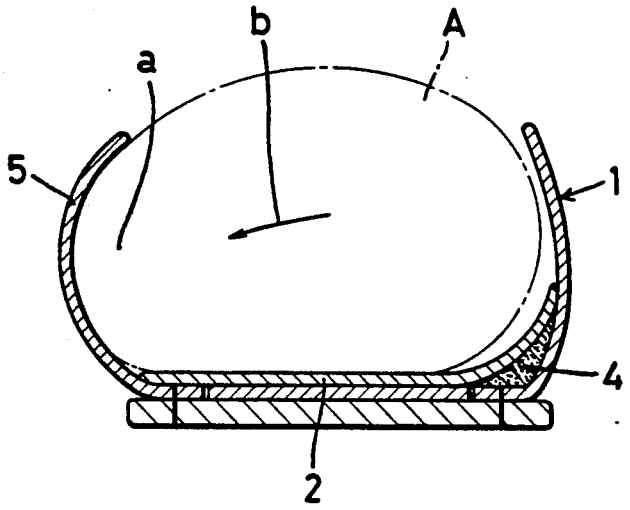
FIG. 10 is a sectional view of conventional footwear.
Figure 11:
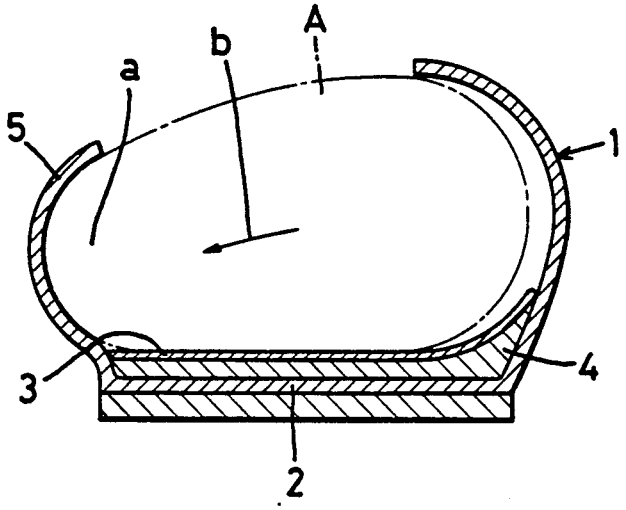
FIG. 11 is a longitudinal sectional view of an application of a conventional insole pad.
Figure 12:
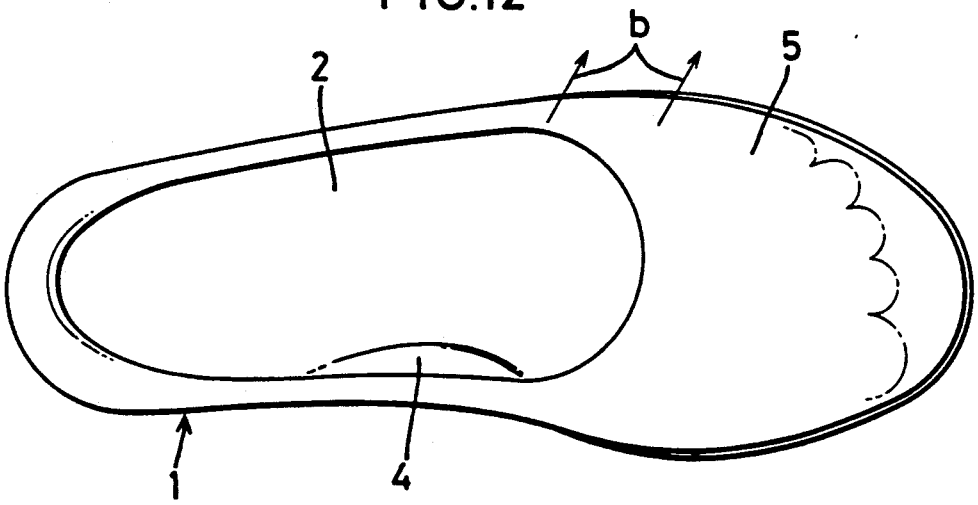
FIG. 12 is a plan view showing a foot and the shift in weight in the conventional footwear.

The footwear and the insole pad according to the present invention have such structures as discussed above and, upon inserting the foot A into the shoe 11 as shown in FIGs. 1 to 4 or the shoe 11 employing inside thereof the insole pad 21 as shown in FIGS. 5 to 9, the outside arch and the plantar arch of the foot A are, as shown in FIGS. 4 and 9, fitted to the arch extrusions 13 and 16, respectively, and the concavity between the first and second toes is placed on the extrusion 15 for preventing of slippage of the foot relative to the pad 21.

Thus, the periphery of the sole of the foot is maintained in a manner in which it is lifted by the arch extrusions 13 and 16, and upon walking, the shifting of the weight rested on the foot toward the outside is supported by the outside arch extrusion 13, while the extrusion 15 prevents forward and sideways slippages.

By supporting the shift in weight with the arch extrusion 13 as mentioned above, as shown in FIGs. 4 or 9, foot deformation is prevented and deformation of an instep strap 18 of the shoe 11 is also prevented. At the same time, because the weight is gathered to the center of the body, a walking posture can be improved and especially in the case of wearing high heels, bowleggedness can be prevented. A sense of fatigue from a long walk can also be reduced.

Further, more pleasant walking is obtainable due to the inside arch extrusion 16 moderately stimulating the plantar arch, which results in the promotion of blood circulation and a reduction in the sense of fatigue of the foot.

Moreover, the extrusion 15 for preventing slippage provided on the insole at a location corresponding to the concavity between the first and the second toes properly stimulates the first and second toes, making it possible to reduce the fatigue of the foot and to get rid of stress.

It should be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. An article of footwear comprising an outsole; an upper fixed to the outsole; and an insole extending over said outsole; said insole having an upper surface on which a foot of a wearer of the footwear will rest, an outer periphery in a shape generally corresponding to the outline of a foot, an inside arch extrusion extending along and exposed at the upper surface of the insole at a location adjacent one portion of the outer periphery of the insole corresponding to the plantar arch of the foot, an outside arch extrusion extending along and exposed at the upper surface of the insole at a location adjacent another portion of the outer periphery of the insole corresponding to the outside arch of the foot, and a third extrusion exposed at the upper surface of the insole at a location corresponding to the concavity between the first and second toes of the foot; said outside arch extrusion increasing in thickness toward said another portion of the outer periphery of the insole so as to support an outward shifting of weight exerted by a foot of a wearer of the footwear, said inside arch extrusion increasing in thickness toward the said one portion of the outer periphery of the insole so as to support and moderately stimulate the plantar arch of a foot of a wearer of the footwear, and said third extrusion forming a protrusion having a generally triangular pyramidal shape so as to inhibit a foot of a wearer of the footwear from slipping forward and sidewards relative to the insole.

2. An article of footwear as claimed in claim 1, wherein said extrusions each consist of silicon resin.

3. An insole pad having an upper surface, an outer periphery in a shape generally corresponding to the outline of a foot, an inside arch extrusion extending along and exposed at the upper surface of the insole pad adjacent one portion of the outer periphery thereof corresponding to the plantar arch of a foot of a user of the insole pad, an outside arch extrusion extending along and exposed at a location adjacent another portion of the outer periphery corresponding to the outside arch of the foot of a user of the insole pad, and a third extrusion exposed at the upper surface of the insole pad at a location corresponding to the concavity between the first and second toes of the foot of a user of the insole pad, said outside arch extrusion increasing in thickness toward said another portion of the outer periphery of the insole pad so as to support an outward shifting of weight exerted by a foot of a user of the insole pad, said inside arch extrusion increasing in thickness toward said one portion of the outer periphery of the insole pad so as to support and moderately stimulate the plantar arch of a foot of the user of the insole pad, and said third extrusion forming a protrusion having a generally triangular pyramidal shape so as to inhibit a foot of a user of the insole pad from slipping forward and sidewards relative to the insole pad.

4. An insole pad as claimed in claim 3, wherein said extrusions each consist of silicon resin.

* * * * *